US005186560A

United States Patent [19]

Holloway

[11] Patent Number: 5,186,560

[45] Date of Patent: Feb. 16, 1993

[54] INNERBODY FLEX TAB COSMETIC DISPENSER

[75] Inventor: Thomas F. Holloway, Southbury, Conn.

[73] Assignee: Risdon Corporation, Naugatuck, Conn.

[21] Appl. No.: 831,189

[22] Filed: Feb. 5, 1992

[51] Int. Cl.[5] ..... A45D 40/12; A45D 40/06

[52] U.S. Cl. ..... 401/78; 401/80; 401/87

[58] Field of Search ..... 401/78, 80, 68, 75, 401/87

[56] References Cited

U.S. PATENT DOCUMENTS

| | | | |
|---|---|---|---|
| 2,022,075 | 11/1935 | Cabrera | 206/56 |
| 2,840,229 | 6/1958 | Hopgood | 206/56 |
| 2,840,231 | 6/1958 | Reichenbach | 206/56 |
| 2,858,937 | 11/1958 | Hoffman | 206/56 |
| 2,913,103 | 11/1959 | Isele | 206/56 |
| 3,272,327 | 9/1966 | Busch | 206/56 |
| 3,298,509 | 1/1967 | Hultgren | 206/56 |
| 3,335,853 | 8/1967 | Geisel | 206/56 |
| 3,539,266 | 11/1970 | Hultgren | 401/78 |
| 3,850,183 | 11/1974 | Gruska | 132/88.7 |
| 4,750,501 | 6/1988 | Ackermann et al. | 132/79 |
| 4,812,066 | 3/1989 | Gueret | 401/78 |

FOREIGN PATENT DOCUMENTS 1118889 7/1968 United Kingdom .

*Primary Examiner*—Steven A. Bratlie

*Attorney, Agent, or Firm*—St. Onge Steward Johnston & Reens

[57] ABSTRACT

A cosmetic preparation dispenser is provided that has flex tabs formed on the lower end of the innerbody that bear against the cam sleeve to provide a desirable swivel torque, and which extend inwardly to engage or confine the elevator cup when it is fully retracted, to prevent vibration of the cup within the innerbody. Damage to a cosmetic pomade held in the cup is less likely during transport because the cup is secured. The flex tabs also minimize pomade back-off during consumer use by providing a frictional braking effect.

16 Claims, 4 Drawing Sheets

INNERBODY FLEX TAB COSMETIC DISPENSER

FIELD OF THE INVENTION

The present invention relates to the field of cosmetic and lipstick dispensers, and particularly to a dispenser suited to minimize damage of a cosmetic stick provided therein.

BACKGROUND OF THE INVENTION

Cosmetic stick damage is a continuing problem for the manufacturers of cosmetic dispensers. Cosmetic stick damage is often the result of excessive play among the components of the dispenser, which can cause the cosmetic stick to wobble and impact the inner walls of the dispenser, causing damage to the stick. For example, a lipstick pomade is a relatively fragile product which may be broken by such impact. Another problem is "pomade back-off" which arises when a consumer applies lipstick and holds only the lower portion of the case. A downward force is applied to the elevator cup by the pressure of the consumer's lips against the pomade. This causes the elevator cup and pomade to to be forced down into the dispenser case.

Conventional propel/repel lipstick dispensers typically have an outer helical cam track sleeve and a longitudinal track innerbody rotatable inside the cam sleeve to axially propel and retract an elevator cup with a lug or lugs that track in the cam track and in the longitudinal track. One such conventional dispenser is disclosed, for example, in Hultgren, U.S. Pat. No. 3,298,509.

In these conventional dispensers there is often a clearance between the lower end of the elevator cup and the innerbody due to the molding requirements and the shrinkage of the plastic parts after molding. This clearance is sufficient that the cup may wobble inside the innerbody, and this wobble can lead to damage to the cosmetic pomade during shipment.

It is known in the art to provide cosmetic dispensers such as lipstick cases that have a particular frictional "feel" to the consumer operator when the dispenser is operated to extend or retract the cosmetic stick. It is desirable that the swivel torque needed to rotate the dispenser components to dispense the lipstick be as nearly constant as possible, regardless of whether the dispenser is nearly full or exhausted of the cosmetic. The swivel torque should be significant enough to impart a firm feel to the dispenser. Looseness, uneven drag, or inconsistency of torque can be interpreted by the consumer as indicating an inferior quality product.

The prior art has attempted to provide the desired firmness and consistency of swivel torque by a number of devices. U.S. Pat. No. 4,750,501 to Ackermann et al. is an example of one type of cosmetic applicator wherein an objective is to impart an even drag and swivel torque during operation.

In other prior art devices, two lugs or tabs are provided on the elevator cup to press against the innerbody or the cam sleeve to provide frictional interference therebetween, and also ribs have been provided on the innerbody that frictionally fit against the elevator cup. However, these prior art devices have generally suffered from inconsistent swivel torque along the travel of the elevator cup as it moves from the extended to the retracted position. This problem arises because the effective inner diameter of the innerbody can vary along its length and thereby vary the swivel torque in an undesirable manner. The dispenser can therefore tend to feel looser when the cup is at one end and tighter when the cup is at the other end.

SUMMARY OF THE INVENTION

It is an object of the invention to provide an improved cosmetic preparation dispenser having a mechanism to lock or confine a retracted elevator cup in place to minimize possible damage to a cosmetic stick placed in the elevator cup. It is a further object of the invention to provide such a dispenser with a desirable consistent swivel torque and which imparts a luxurious feel associated in the perception of the consumer with a higher quality product. It is a further object of the invention to provide such a dispenser that can resist undesirable pomade back-off.

In accordance with the present invention, an innerbody flex tab cosmetic dispenser comprises a cam sleeve with an inner helical track, an innerbody with longitudinal tracks, and an elevator cup with a cam follower lug that permits the cup to move in an axial path by relative rotation of the innerbody and cam sleeve. The innerbody is provided with at least one and preferably two or more resilient flex tabs. The resilient flex tabs are formed with and attached to the lower end of the innerbody, and are at least partially cut away from the innerbody. The tabs extend radially outwardly sufficiently to frictionally engage the inner wall of the cam sleeve. The tabs also have sufficient resilience to be flexed radially inwardly. The elevator cup has a reduced radius zone below the lug so that there is a clearance to permit retraction of the elevator cup into the innerbody without interference between the tab and the elevator cup. After such retraction, the elevator cup is rotatable in the innerbody by further relative rotation of the innerbody and the cam sleeve to cause the elevator cup lug to track into a lateral track segment so that the cup is rotated. This causes the reduced radius zone to rotate away from the tabs so that the tabs can secure the elevator cup.

The tabs may comprise horizontal or vertical elements, and they may be attached at one or both ends. Preferably, they are cutaway from the innerbody to provide the necessary resilience.

The flex tab element provides a frictional braking effect against the cam sleeve to give the desired drag and constant swivel torque. Because the frictional interference takes place at a fixed location with the frictional element engaging the cam sleeve along a circumferential path on the radially inward sidewall of the extension of the cam sleeve, an even drag is provided that is relatively insensitive to the position of the elevator cup along the innerbody. This frictional effect gives the desired feel and helps prevent pomade backoff during consumer use. In addition, the flex tab elements serve to engage or confine the elevator cup when it is fully retracted to prevent damage to the pomade that may occur due to impact of the pomade against the inner walls of the innerbody because of vibration during transit.

Other objects, aspects and features of the present invention in addition to those mentioned above will be pointed out in or will be understood from the following detailed description provided in conjunction with the accompanying drawings.

DETAILED DESCRIPTION OF THE PREFERRED EMBODIMENT

Figure 1:
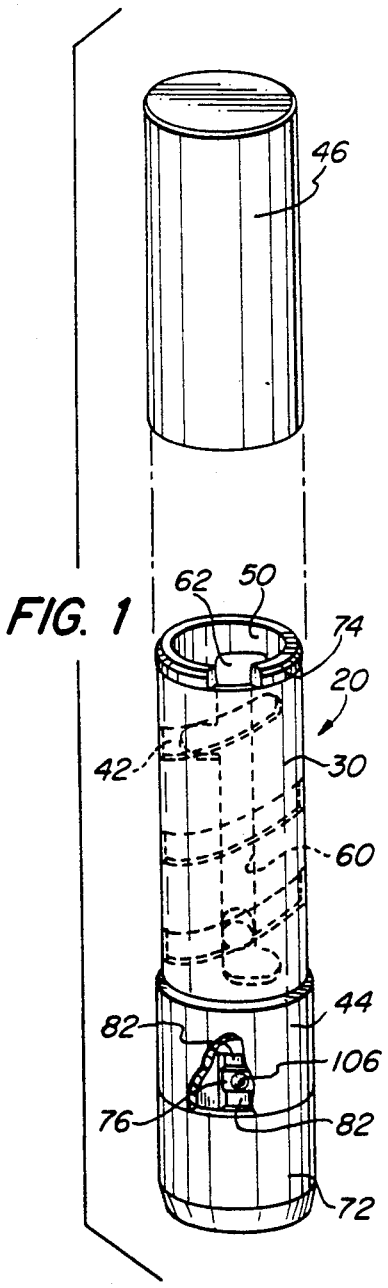
FIG. 1 is a perspective view of an embodiment of an innerbody flex tab cosmetic dispenser in accordance with the invention with a partial cutaway showing one of the frictional flex tabs of the present invention.
Figure 2:
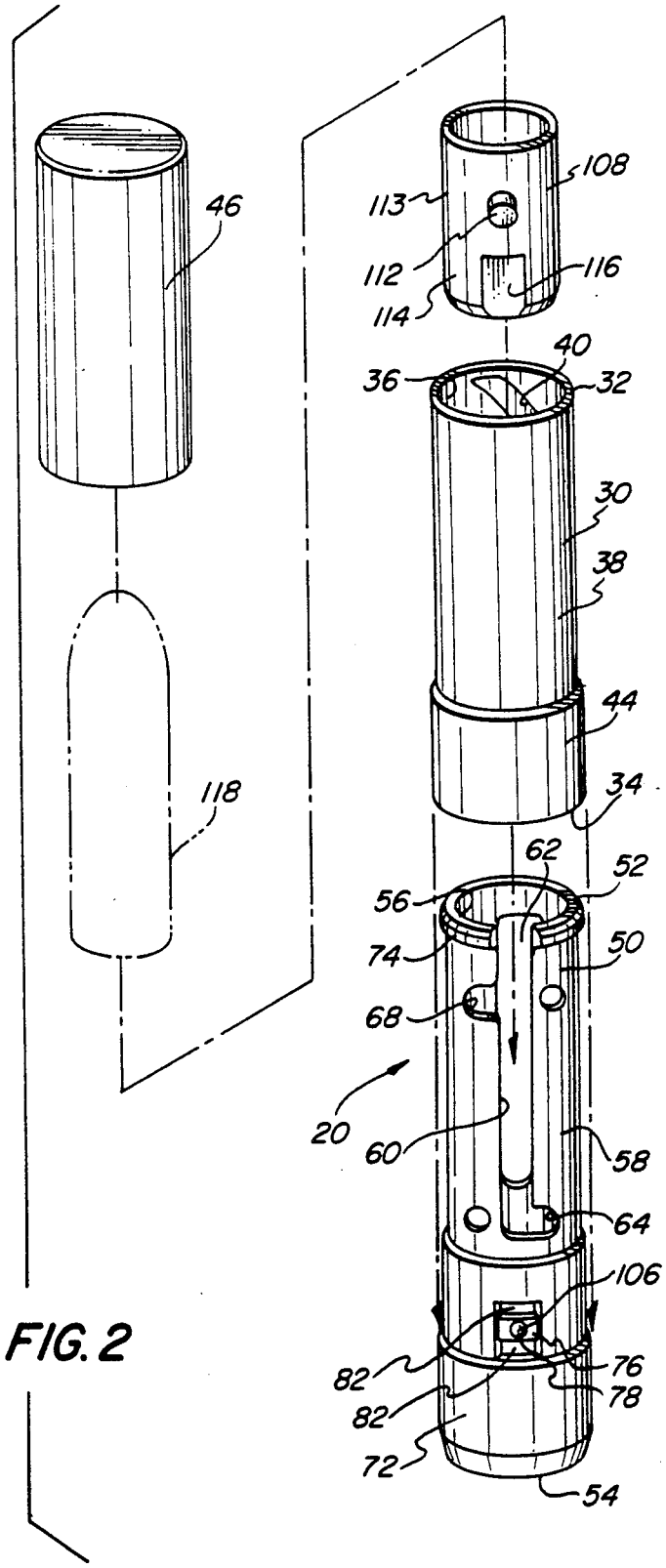
FIG. 2 is an exploded view of the dispenser of FIG. 1.

Referring now to FIGS. 1-12, where like elements are identified by like numbers in the drawings, an innerbody flex tab cosmetic dispenser is shown generally at 20. Dispenser 20 comprises a cam sleeve 30, an innerbody 50, and an elevator cup 108.

Cam sleeve 30 is rigid and tubular and has an upper end 32 and a lower end 34. Cam sleeve 30 has an inner wall 36 and an outer wall 38. At least one and preferably two internal helical threads 40 and 42 are formed on the inner wall 36. Helical threads 40 and 42 are located 180 degrees apart and extend along a substantial length of the inner wall 36 of the cam sleeve 30. Cam sleeve 30 has an unthreaded lower inner wall segment 44 at its lower end 34. An ornamental outer shell 46 such as a brass tube may be fitted over the outer wall 38 of the cam sleeve for decoration.

Innerbody 50 is also tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 and 62 which extend along the axial length of the innerbody 50 and which extend through the walls 56 and 58 of the innerbody 50 along a substantial length of the innerbody 50. Preferably, one of the longitudinal tracks 60 extends to the upper end 52 of the innerbody 50 so that it is open at its upper end. The other longitudinal track 62 preferably does not so extend so that it is closed at its upper end.

The longitudinal tracks 60 and 62 have at their lower ends lower lateral track segments 64 and 66 respectively which preferably extend perpendicularly from the longitudinal tracks 60 and 62. The longitudinal tracks 60 and 62 preferably also have at their upper ends upper lateral track segments 68 and 70 respectively which preferably also extend perpendicularly from the longitudinal tracks 60 and 62. Preferably, the upper lateral tracks 68 and 70 extend in the opposite direction from the lower lateral tracks 64 and 66. The upper lateral track segments 68 and 70 assist the elevator cup 108 to be locked in an extended position for application of a cosmetic.

The innerbody 50 is interlocked with the cam sleeve 30 so that rotation or application of a swivel torque to the cam sleeve 30 relative to innerbody 50 can be accomplished by gripping an extended cylindrical portion knob 72 on innerbody 50 with one hand and cam sleeve 30 with the other hand to raise or lower elevator cup 108 as set forth hereafter. The cam sleeve 30 and innerbody 50 are preferably secured together by a retaining lip 74 on the upper end 52 of innerbody 50 that retains the upper end 32 of cam sleeve 30 in place on innerbody 50. The knob 72 of innerbody 50 has a larger diameter than the lower end 34 of cam sleeve 30 and thereby holds the cam sleeve lower end 34 in place. Alternative retaining means might also comprise an interfitting combination of a rib and channel for receiving the rib.

At least one and preferably two resilient flex tabs 76 are formed with and attached to the innerbody 50 above knob 72. The two flex tabs 76 are located about 180 degrees apart. The tabs 76 are at least partially cut away from the innerbody 50 to enhance resilience. The flex tabs 76 have various embodiments as described hereafter and each has sufficient resilience to be flexed radially inwardly.

Figure 8:
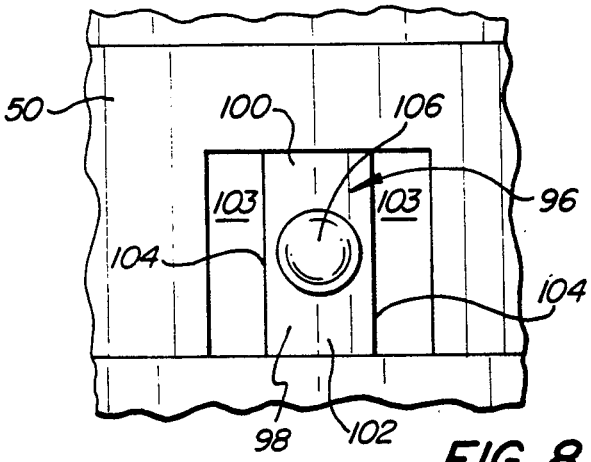
FIG. 8 is a detail side elevation view of a third embodiment of the flex tab of an embodiment of a dispenser in accordance with the invention.
Figure 9:
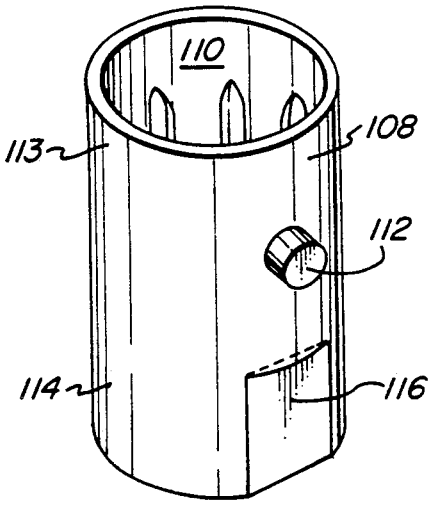
FIG. 9 is a perspective view of an embodiment of an elevator cup of a dispenser in accordance with the invention.
Figure 10:
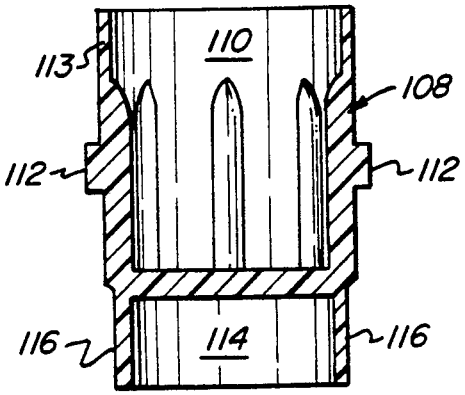
FIG. 10 is a cross-sectional view of the elevator cup of FIG. 9.
Figure 12:
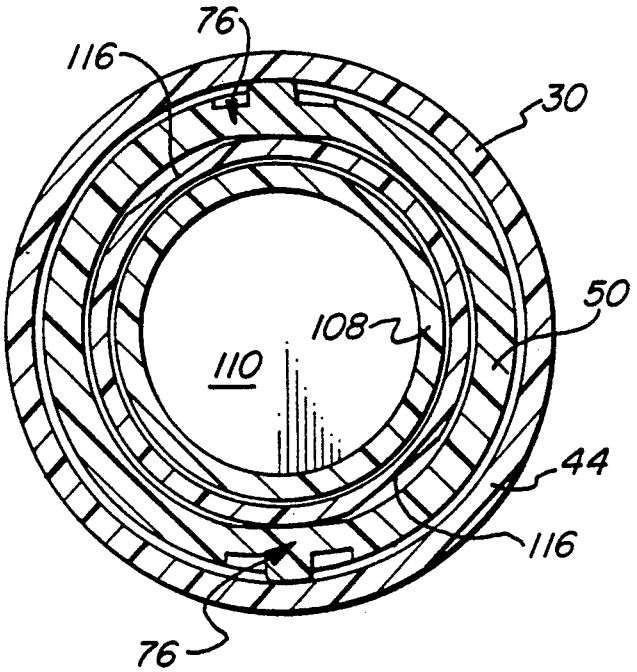
FIG. 12 is a cross sectional view of the dispenser of FIG. 11 showing the flex tabs of the present invention when the elevator cup is retracted into the innerbody and moved into a locked position.

Referring now to FIGS. 1-4, an embodiment of a flex tab is shown at 76 and is a horizontal element 78 which is attached at its two horizontal ends 80 to the innerbody 50. The flex tab 76 is cutaway from and separated from the innerbody 50 by spaces 82 located along the upper edge 84 and lower edge 86 of the horizontal element. Another embodiment of the flex tab in FIGS. 5-7 as 88 and comprises a horizontal element 90 attached at only one horizontal end 92 to the innerbody 50. Flex tab 88 is therefore cutaway and separated from the innerbody 50 by spaces 94 located along three edges of the horizontal element 90. A further embodiment of a flex tab is shown in FIG. 8 as 96 and comprises a vertical element 98 attached at two vertical ends 100 and 102 to the innerbody 50. Flex tab 96 is therefore cutaway and separated from the innerbody 50 by spaces 103 located along lateral edges 104 of the vertical element 98.

The flex tabs 76, 88 or 96 are preferably provided with a radially outwardly extending bump 106 to provide a frictional engagement with the lower inner segment 44 of the cam sleeve 30, whereby the frictional engagement provides a relatively consistent drag between the bumps 106 and the lower inner segment 44 of the cam sleeve 30 when the innerbody and cam sleeve are rotated relative to each other. This provides the desired sense or feel of quality to the consumer user. In addition, the frictional braking effect minimizes undesirable pomade back-off during use of the dispenser. Such back-off can otherwise occur when pressure is applied to a cosmetic pomade during use. Bump 106 preferably has a generally hemispherical shape with a flattened frictional surface.

Referring now to FIGS. 1-3 and 9-12, the elevator cup 108 is generally cylindrical and has a chamber 110 for containing a cosmetic preparation such as lipstick. The cup 108 is fitted into the innerbody 50. Cup 108 has at least one and preferably two cam follower lugs 112 for seating in and following in the longitudinal tracks 60 and 62 of the innerbody 50 and the helical threads 40 and 42 of the cam sleeve 30. The lugs 112 are located 180 degrees apart and have a sufficient length to extend through the longitudinal tracks 60 and 62 to engage the helical threads 40 and 42. The cup 108 has an upper segment 113 and a lower skirt 114. Located below the lugs 112 are reduced radius zones 116 in skirt 114. In the reduced radius zones 116 the cup 108 has a lesser radius than in the upper segment 113. The reduced radius zones 116 are preferably rectangular flat areas located below lugs 112.

Figure 3:
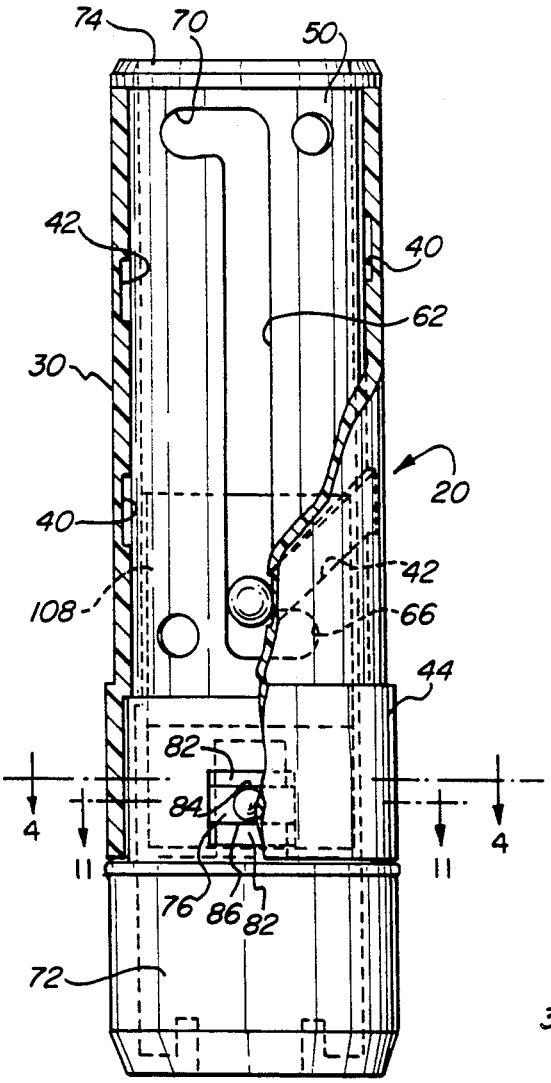
FIG. 3 is a side elevation view of the dispenser of FIG. 1 with partial cutaway.
Figure 11:
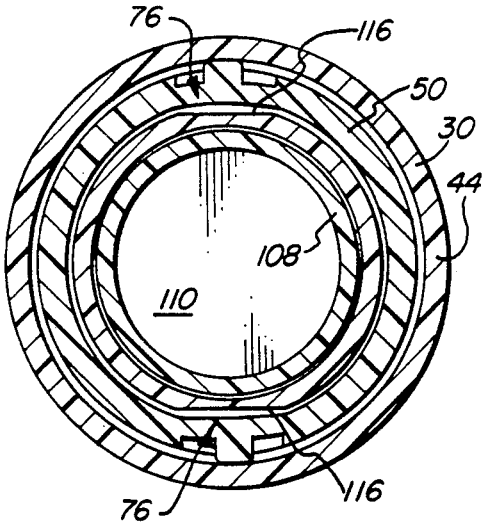
FIG. 11 is a cross sectional view of the dispenser of FIG. 3 along line 11—11 showing the flex tabs of the present invention when the elevator cup is retracted into the innerbody but not yet locked.
Figure 4:
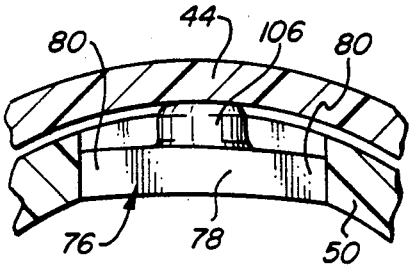
FIG. 4 is a detail cross sectional view of one of the flex tabs of the dispenser of FIG. 3 along the line 4—4.
Figure 5:
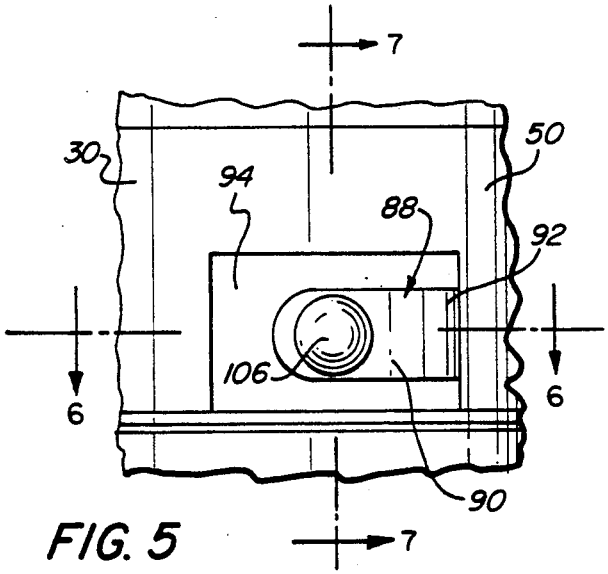
FIG. 5 is a detail side elevation view of a second embodiment of the flex tab of an embodiment of a dispenser in accordance with the invention.
Figure 6:
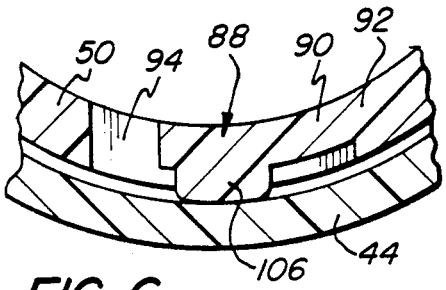
FIG. 6 is a detail cross-sectional view of the flex tab of FIG. 5 along the line 6—6 thereof.
Figure 7:
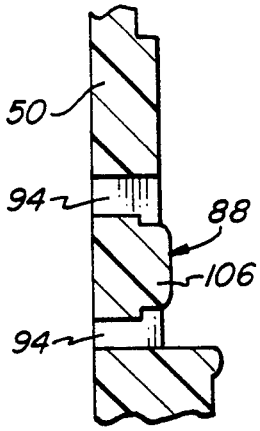
FIG. 7 is a detail cross-sectional view of the flex tab of FIG. 5 along the line 7—7 thereof.

Cup 108 is movable in an axial path in a conventional manner by relative rotation of the innerbody 50 and cam sleeve 30 by virtue of the lugs 112 seating in the helical threads 40 and 42 of cam sleeve 30 and the longitudinal tracks 60 and 62 of innerbody 50. The relative rotation of the cam sleeve 30 and innerbody 50 causes the cup 108 to move axially to propel the elevator cup 108 to an extended position, and relative rotation in the opposite direction causes the elevator cup 108 to retract to a retracted position as shown in FIG. 3. In the preferred embodiment, the helical threads 40 and 42 are right hand threads in the cam sleeve 30 and have a thread pitch of about 30 degrees so that each makes one complete revolution as the cup 108 traverses the length of the dispenser 20. This is desirable as only a single turn is needed to fully activate the dispenser 20.

The reduced radius zones 116 located below the lugs 112 provide the elevator cup 108 with sufficient clearance to be retracted into the innerbody 50 to a limit of longitudinal travel without interference between the flex tabs 76, 88 or 96 and the elevator cup 108. In particular, the reduced radius zones 116 provide sufficient clearance for the flex tabs 76, 88 or 96. Further relative rotation of the innerbody 50 and cam sleeve 30 causes the elevator cup lugs 112 to track into the lower lateral track segments 64 and 66, causing the cup 108 to be rotated until the reduced radius zones 116 are rotated away from the flex tabs 76, 88 or 96. At this point, the flex tabs 76, 88 or 96 frictionally engage or confine the elevator cup 108 and hold it in place. The gripping or confining of the cup 108 by the flex tabs 76, 88 or 96 is in part caused by the counter pressure of the lower inner segment 44 of the cam sleeve 30 which presses back against the flex tabs 76, 88 or 96 which are being forced radially outwardly by the cup 108.

The secure gripping or confinement of the cup 108 minimizes vibration of the cup in the innerbody and consequently reduces the likelihood of damage to a cosmetic stick 118 installed in cup 108 that could occur if the stick was subject to impact against the innerbody inner wall 56 due to the vibration.

In an alternative embodiment, it is possible to locate the flex tabs on the cam sleeve so that they extend radially inwardly to bear against the elevator cup through a properly positioned opening in the innerbody. In such case it is desirable to have an outer annular wall provided on the innerbody to wrap around the cam sleeve and the flex tabs to keep the flex tabs from escaping radially outwardly. Otherwise the desired braking and cup securing functions could be ineffective.

The innerbody 50 and the cam sleeve 30 are preferably formed by molding from a thermoplastic such as styrene. The flex tabs are molded into the innerbody and provide the additional benefit of pierced walls in the innerbody that correspond to holding ribs in a mold that help to hold a core pin in an upright and steady position during the molding process.

Typically, a cap will also be provided with the dispenser 20. Such a cap has a lower end suited for fitting over the cam sleeve and its decorative shell, and can be frictionally mounted on the lower end of the innerbody 50. For decorative enhancement, the cap and the lower end of innerbody 50 may also have decorative shells fitted over them. These decorative shells may be affixed to their respective underlying structural components by gluing and/or by forming their ends to clip onto the ends of the cam sleeve, cap and innerbody lower end.

The present invention therefore provides a new and useful cosmetic dispenser with an inner body flex tab suited to grip or confine the elevator cup to prevent damage to a cosmetic pomade during transport. In addition, the flex tabs provide a frictional braking effect that gives the dispenser a desired quality feel and also prevents pomade backoff during application of the cosmetic.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. An innerbody flex tab cosmetic dispenser, comprising:

a tubular cam sleeve having upper and lower ends and inner and outer walls and having an internal helical thread extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody, said longitudinal track being provided with a lateral track segment extending laterally from a lower end of said longitudinal track;

a resilient tab formed with and attached to said innerbody and being at least partially cut away from said innerbody, said tab being retained from radially outward movement by frictional engagement with said inner wall of said cam sleeve, said tab having sufficient resilience to be flexed radially inwardly from said innerbody;

a generally cylindrical elevator cup for containing a cosmetic preparation, fitted into said innerbody and having a cam follower lug extending through said longitudinal track to engage said helical thread, said elevator cup being movable in an axial path by relative rotation of said innerbody and cam sleeve, and having a reduced radius zone below said lug whereby said elevator cup has a clearance to permit retraction of said elevator cup into said innerbody without interference between said resilient tab and said elevator cup, by relative rotation of said innerbody and said cam sleeve, said elevator cup being rotatable in said innerbody by further relative rotation of said innerbody and said cam sleeve to cause said elevator cup lug to track into said lateral track segment such that said cup is rotated until said reduced radius zone is rotated away from said tab and said tab engages or confines a cylindrical outer wall of said elevator cup.

2. An innerbody flex tab cosmetic dispenser in accordance with claim 1, wherein there are two said resilient tabs.

3. An innerbody flex tab cosmetic dispenser in accordance with claim 2, wherein said two resilient tabs are located 180 degrees apart on opposite sides of said innerbody.

4. An innerbody flex tab cosmetic dispenser in accordance with claim 1, wherein said resilient tab comprises a horizontal element attached at two horizontal ends to said innerbody and separated from said innerbody by spaces located along upper and lower edges of said horizontal element.

5. An innerbody flex tab cosmetic dispenser in accordance with claim 1, wherein said resilient tab comprises a horizontal element attached at one horizontal end to said innerbody and separated from said innerbody by spaces located along three edges of said horizontal element.

6. An innerbody flex tab cosmetic dispenser in accordance with claim 1, wherein said resilient tab comprises a vertical element attached at two vertical ends to said innerbody and separated from said innerbody by spaces located along lateral edges of said vertical element.

7. An innerbody flex tab cosmetic dispenser in accordance with claim 1, further comprising an upper lateral track segment extending laterally from said longitudinal track at an upper end thereof for locking said elevator cup in an extended position.

8. An innerbody flex tab cosmetic dispenser, comprising:

a rigid tubular cam sleeve having upper and lower ends and inner and outer walls and having two internal helical threads located 180 degrees apart and extending along a substantial length of the inner wall of said cam sleeve, and having an unthreaded inner lower segment;

a tubular innerbody having upper and lower ends, said innerbody being fitted into said tubular cam sleeve and being provided with two longitudinal tracks extending through the wall of said innerbody along a substantial length of said innerbody, said longitudinal tracks being provided at lower ends thereof with lower lateral track segments extending laterally from said longitudinal tracks;

two resilient flex tabs formed with and attached to said lower end of said innerbody and located about 180 degrees apart, said tabs being at least partially cut away from said innerbody to enhance resilience of said tabs, and each being provided with a radially outwardly extending bump to provide a frictional engagement with said inner lower segment of said cam sleeve, said lower inner segment of said cam sleeve retaining said flex tabs from radial outward movement, whereby said frictional engagement provides a relatively consistent drag between said bumps and said inner lower segment of said cam sleeve when said innerbody and cam sleeve are rotated relative to each other, said tabs having sufficient resilience to be flexed radially inwardly from said innerbody;

a generally cylindrical elevator cup for containing a cosmetic preparation, fitted into said innerbody and having two cam follower lugs located 180 degrees apart and having a sufficient length to extend through said longitudinal tracks to engage said helical threads, said elevator cup being movable in an axial path by relative rotation of said innerbody and cam sleeve, and having reduced radius zones located below said lugs whereby said elevator cup has sufficient clearance to be retracted into said innerbody by relative rotation of said innerbody and cam sleeve to a limit of longitudinal travel without interference between said flex tabs and said elevator cup in the reduced radius zones, and whereby further relative rotation of said innerbody and cam sleeve causes said elevator cup lugs to be located in said lateral track segments such that said cup is rotated until said reduced radius zones are rotated away from said flex tabs and said flex tabs engage or confine said elevator cup.

9. An innerbody flex tab cosmetic dispenser in accordance with claim 8, wherein at least one of said flex tabs comprises a horizontal element attached at two horizontal ends to said innerbody and separated from said innerbody by spaces located along upper and lower edges of said horizontal element.

10. An innerbody flex tab cosmetic dispenser in accordance with claim 8, wherein at least one of said flex tabs comprises a horizontal element attached at one horizontal end to said innerbody and separated from said innerbody by spaces located along three edges of said horizontal element.

11. An innerbody flex tab cosmetic dispenser in accordance with claim 8, wherein at least one of said flex tabs comprises a vertical element attached at two vertical ends to said innerbody and separated from said innerbody by spaces located along lateral edges of said vertical element.

12. An innerbody flex tab cosmetic dispenser in accordance with claim 8, further comprising upper lateral track segments extending laterally from said longitudinal tracks at upper ends thereof for locking said elevator cup in an extended position.

13. In a cosmetic dispenser, comprising: a tubular cam sleeve having upper and lower ends and inner and outer walls and having an internal helical thread extending along a substantial length of the inner wall of said cam sleeve; a tubular innerbody having upper and lower ends, said innerbody being fitted into said tubular cam sleeve and being provided with a longitudinal track extending through the wall of said innerbody along a substantial length of said innerbody, said longitudinal track being provided with a lateral track segment extending laterally from a lower end of said longitudinal track; and a generally cylindrical elevator cup for containing a cosmetic preparation fitted into said innerbody and having a cam follower lug extending through said longitudinal track to engage said helical thread whereby said elevator cup is movable in an axial path by relative rotation of said innerbody and cam sleeve; the improvement comprising:

a resilient tab formed with and attached to said lower end of said innerbody and being at least partially cut away from said innerbody, said tab extending radially outwardly sufficiently to frictionally engage said inner wall of said lower end of said cam sleeve, and being retained from radial outward flexing by said inner wall of said lower end of said cam sleeve, said tab having sufficient resilience to be flexed radially inwardly; and said elevator cup having a reduced radius zone below said lug whereby said elevator cup has a clearance to permit retraction of said elevator cup into said innerbody by relative rotation of said innerbody and said cam sleeve without interference between said tab and said elevator cup, said elevator cup being rotatable in said innerbody by further relative rotation of said innerbody and said cam sleeve to cause said elevator cup lug to track into said lateral track segment such that said cup is rotated until said reduced radius zone is rotated away from said tab and said tab engages or confines said elevator cup.

14. In a cosmetic dispenser in accordance with claim 13, wherein there are two said tabs.

15. In a cosmetic dispenser in accordance with claim 14, wherein said two tabs are located 180 degrees apart on opposite sides of said innerbody.

16. A cosmetic dispenser, comprising:

a tubular cam sleeve having upper and lower ends and inner and outer walls and having an internal helical thread extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody, said longitudinal track being provided with a lateral track segment extending laterally from said longitudinal track;

a resilient tab element formed with and extending radially outwardly from one of said innerbody or cam sleeve;

a smooth surface provided on the other of said innerbody or cam sleeve so that said tab element will press against said surface to provide a frictional braking effect therebetween upon the relative rotation of said innerbody and cam sleeve; and a generally cylindrical elevator cup for containing a cosmetic preparation fitted into said innerbody and having a cam follower lug extending through said longitudinal track to engage said helical thread, said elevator cup being movable in an axial path by relative rotation of said innerbody and cam sleeve, said elevator cup having a reduced radius zone whereby said elevator cup has a clearance to permit retraction of said elevator cup into said innerbody by relative rotation of said innerbody and said cam sleeve without interference between said tab element and said elevator cup, said elevator cup being rotatable in said innerbody to cause said elevator cup lug to track into said lateral track segment such that said cup is rotated until said reduced radius zone is rotated away from said tab element and said tab element engages or confines said elevator cup.

* * * * *